US010119233B2

(12) United States Patent
Holman

(10) Patent No.: US 10,119,233 B2
(45) Date of Patent: Nov. 6, 2018

(54) PLOW ASSEMBLY WITH CUSHIONING ATTACHMENT

(71) Applicant: STONEBROOKE EQUIPMENT INC., Burnsville, MN (US)

(72) Inventor: Jerry D. Holman, Lakeville, MN (US)

(73) Assignee: STONEBROOKE EQUIPMENT, INC., Burnsville, MN (US)

( * ) Notice: Subject to any disclaimer, the term of this patent is extended or adjusted under 35 U.S.C. 154(b) by 0 days.

(21) Appl. No.: 15/472,339

(22) Filed: Mar. 29, 2017

(65) Prior Publication Data

US 2017/0284045 A1 Oct. 5, 2017

Related U.S. Application Data

(60) Provisional application No. 62/316,009, filed on Mar. 31, 2016.

(51) Int. Cl.
*E01H 5/06* (2006.01)

(52) U.S. Cl.
CPC ..... *E01H 5/062* (2013.01)

(58) Field of Classification Search
CPC ..... E01H 5/062; E01H 5/063
See application file for complete search history.

(56) References Cited

U.S. PATENT DOCUMENTS 1,383,409 A 7/1921 Liddell
3,477,151 A 11/1969 Zanella
4,145,825 A 3/1979 Bertolino
4,669,205 A 6/1987 Smathers
5,129,169 A 7/1992 Aubichon
5,279,236 A * 1/1994 Truax ..... A01B 21/086 111/139
5,899,007 A 5/1999 Niemela et al.
5,960,569 A * 10/1999 Molstad ..... E02F 3/7613 172/816
6,102,132 A * 8/2000 Schimke ..... A01B 15/18 111/139
6,178,669 B1 1/2001 Quenzi et al.
6,219,943 B1 * 4/2001 Kitchell ..... E01H 5/063 172/811
6,354,025 B1 * 3/2002 Kirchell ..... E01H 5/063 172/816
6,393,737 B2 5/2002 Quenzi et al.
(Continued)

FOREIGN PATENT DOCUMENTS

DE 1299675 7/1969

*Primary Examiner* — Matthew D. Troutman
(74) *Attorney, Agent, or Firm* — Honigman Miller Schwartz and Cohn, LLP

(57) ABSTRACT

An accessory assembly, such as a plow assembly for a vehicle, includes a mounting structure configured to mount at a vehicle, a support structure and an accessory or plow. The support structure includes a vehicle end and an attaching end, with the vehicle end attached to the mounting structure via a cushioning assembly. The accessory or plow is pivotally attached at the attaching end of the support structure and is pivotable about a generally vertical axis. The cushioning assembly includes (i) a first element attached at the vehicle end of the support structure, (ii) a second element attached at the mounting structure, and (iii) a plurality of resilient elements disposed between the first element and the second element.

20 Claims, 21 Drawing Sheets

(56) References Cited

U.S. PATENT DOCUMENTS

| | | | | |
|---|---|---|---|---|
| 6,408,549 | B1 | 6/2002 | Quenzi et al. | |
| 6,412,199 | B1 | 7/2002 | Quenzi et al. | |
| 6,442,877 | B1 | 9/2002 | Quenzi et al. | |
| 6,536,141 | B2 * | 3/2003 | Kitchell | E01H 5/063 172/811 |
| 6,594,924 | B2 | 7/2003 | Curtis | |
| 6,823,615 | B2 | 11/2004 | Strait | |
| 6,928,757 | B2 | 8/2005 | Bloxdorf et al. | |
| 6,941,685 | B2 * | 9/2005 | Goy | E01H 5/06 172/816 |
| 7,107,709 | B2 | 9/2006 | Hamel | |
| 7,134,227 | B2 | 11/2006 | Quenzi et al. | |
| 7,360,327 | B2 | 4/2008 | Osgood et al. | |
| 7,555,853 | B2 | 7/2009 | Paonessa | |
| 7,654,016 | B2 | 2/2010 | Stephan | |
| 7,941,947 | B2 | 5/2011 | Stephan | |
| 7,975,409 | B2 | 7/2011 | Paonessa | |
| 8,776,405 | B2 | 7/2014 | Paonessa | |
| 8,875,419 | B2 * | 11/2014 | Schmeichel | E01H 5/062 37/231 |
| 8,887,413 | B2 | 11/2014 | Miller | |
| 9,255,370 | B2 | 2/2016 | Paonessa | |
| 9,408,339 | B2 * | 8/2016 | Jensen | A01B 61/046 |
| 9,657,450 | B2 * | 5/2017 | Gandolfi | E01H 5/063 |
| 2013/0025629 | A1 | 1/2013 | Vigneault | |
| 2013/0214106 | A1 * | 8/2013 | Gendron | E01H 5/066 248/205.1 |
| 2016/0040379 | A1 | 2/2016 | Vigneault | |

* cited by examiner

PLOW ASSEMBLY WITH CUSHIONING ATTACHMENT

CROSS REFERENCE TO RELATED APPLICATION

The present application claims the filing benefits of U.S. provisional application Ser. No. 62/316,009, filed Mar. 31, 2016, which is hereby incorporated herein by reference in its entirety.

FIELD OF THE INVENTION

The present invention relates generally to the field of plows that attach to a vehicle, such as a skid steer or the like, and are operable to move snow or other materials.

BACKGROUND OF THE INVENTION

It is known to provide a plow at a vehicle. It is also known to use an actuator to raise and lower the plow blade or mold board relative to the vehicle.

SUMMARY OF THE INVENTION

The present invention provides a plow assembly having a cushioning attachment or composite torsion system between a mounting element configured for attachment at a vehicle (such as a skid steer or the like) and a support frame that supports the plow blade relative to the mounting element. The cushioning attachment or composite torsion system comprises a non-circular receiver having a plurality of resilient or compressible or deformable elements disposed therein and engaging a non-circular beam received in the receiver and engaging at least some of the resilient elements. The receiver may be disposed at a vehicle-end of the plow support frame and the beam may be supported at the mounting element, such as in a slot of a bracket of the mounting element.

Thus, as the mounting element is pivoted (such as via actuation of an actuator of the vehicle that pivots the mounting element about a generally horizontal pivot axis relative to the vehicle) and the plow blade engages the ground and thus the down pressure of the plow blade at the ground is increased, the beam may rotate within the receiver and is urged against and compresses the resilient elements (and the beam may slide along the slot in the bracket of the mounting element), with the resilient elements cushioning the plow blade relative to the vehicle so that, even when the down pressure is increased (with the degree of rotation of the beam within the receiver limited by the resilient elements), impact of the blade at an object on the ground is at least partially absorbed by the resilient elements. Likewise, when the mounting element is pivoted in the opposite direction, the beam may rotate in an opposite direction within the receiver (with the degree of rotation of the beam within the receiver again limited by the resilient elements) and is urged against and compresses the resilient elements (and the beam may slide along the slot in the bracket of the mounting element in the opposite direction).

Thus, the present invention provides a plow attachment system, with a composite torsion system that adjustably or resiliently attaches the support frame at the mounting element or plate that attaches to the vehicle. The attachment system of the present invention provides a cushioned raised or lift/carry position that allows the operator to lift and carry the plow blade via the cushioning attachment or composite torsion system which reduces or absorbs bouncing of the plow and is thus easier on the vehicle, and provides a smoother ride for the operator. Also, the cushioning attachment system of the present invention provides impact cushion protection, whereby if the operator runs the plow into an immovable object while plowing, the cushioning attachment or composite torsion system flexes and helps to absorb the shock and cushion the impact, and thus reduces breakage of components. The mounting system of the present invention is suitable for mounting a plow or other accessories at a vehicle, such as, for example, a back drag attachment at a rear of a vehicle or a grapple bucket attachment or asphalt milling machine attachment or the like at the front of the vehicle, with the system providing cushioning of the accessory at the vehicle when the accessory is raised or lowered or when the accessory impacts an object during use.

These and other objects, advantages, purposes and features of the present invention will become apparent upon review of the following specification in conjunction with the drawings.

DESCRIPTION OF THE PREFERRED EMBODIMENTS

Figure 1:
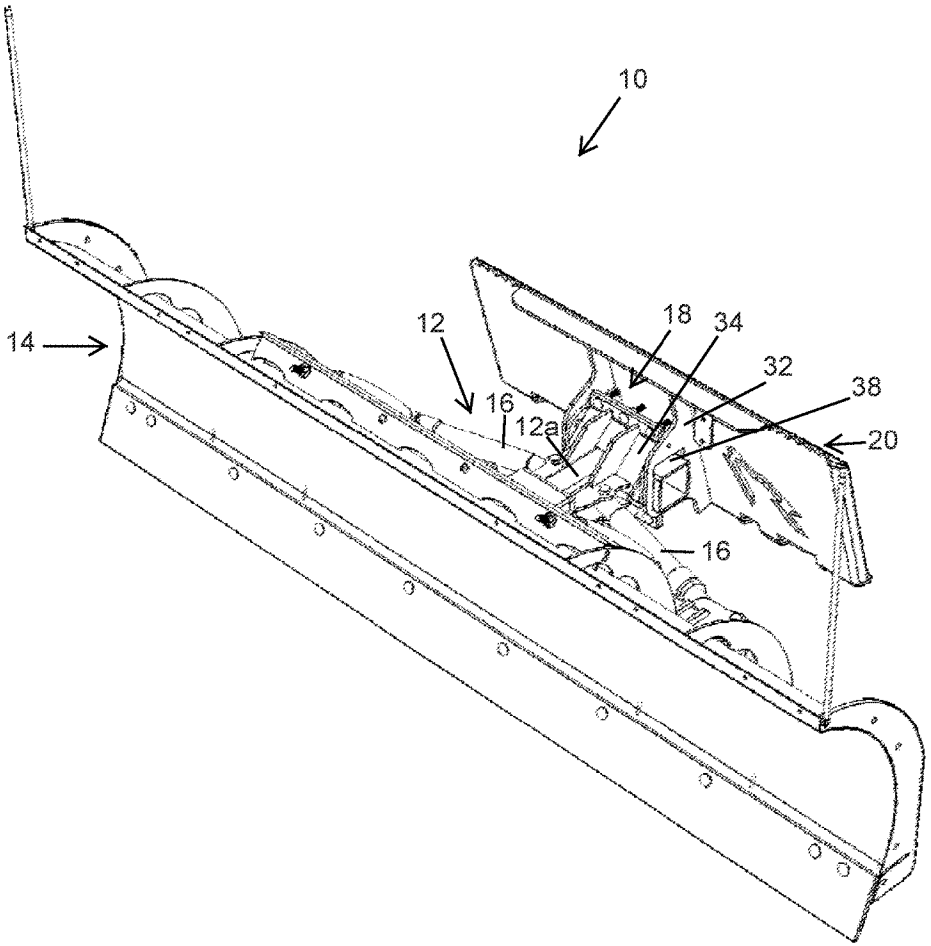
FIG. 1 is a perspective view of a plow assembly in accordance with the present invention, shown in a generally neutral position.
Figure 2:
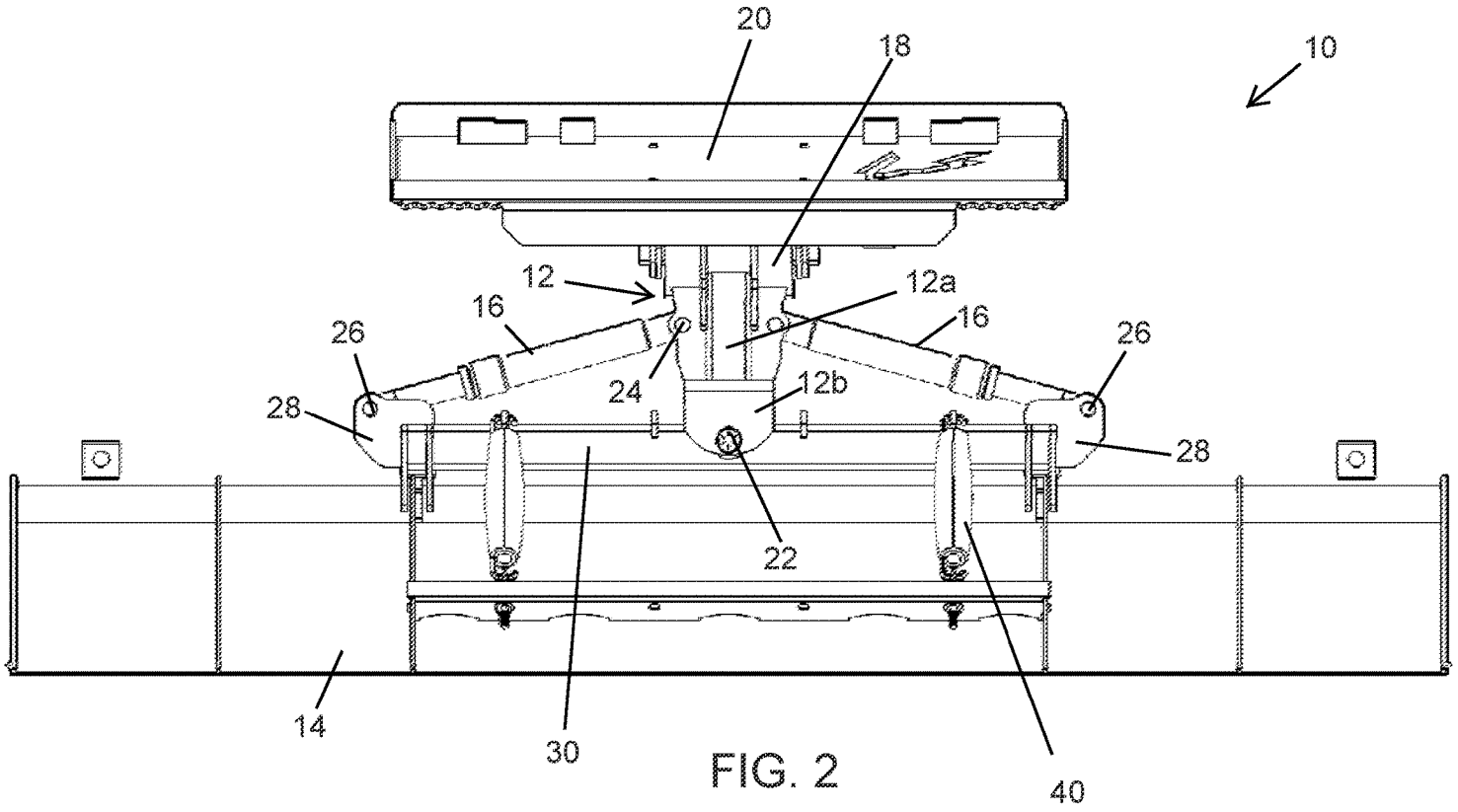
FIG. 2 is a top plan view of the plow assembly of FIG. 1.

Referring now to the drawings and the illustrative embodiments depicted therein, a plow assembly 10 is configured to be mounted to a vehicle (FIG. 21), such as a skid steer or pickup truck or other movable vehicle or the like, via a support assembly 12, such as an A-frame support or the like (FIG. 1). The plow assembly 10 includes a plow or mold board 14 that is pivotally mounted at the support assembly 12 and is pivotable side to side about a generally vertical pivot axis via actuation of a respective one of two actuators 16 (such as hydraulic cylinders or the like). Plow assembly 10 includes a cushioning assembly or composite torsion assembly or system 18 disposed at a mounting element or attachment element 20 that is configured to attach at the vehicle, with the cushioning assembly 18 disposed between the mounting element 20 and the support assembly 12, whereby the cushioning assembly 18 absorbs impact shock of the plow blade hitting objects when the plow is lowered for plowing a surface and/or of the blade bouncing up and down when the vehicle is driven with the plow raised, and allows for smooth continuous adjustment of down pressure of the plow at the surface being plowed, as discussed below.

Figure 4:
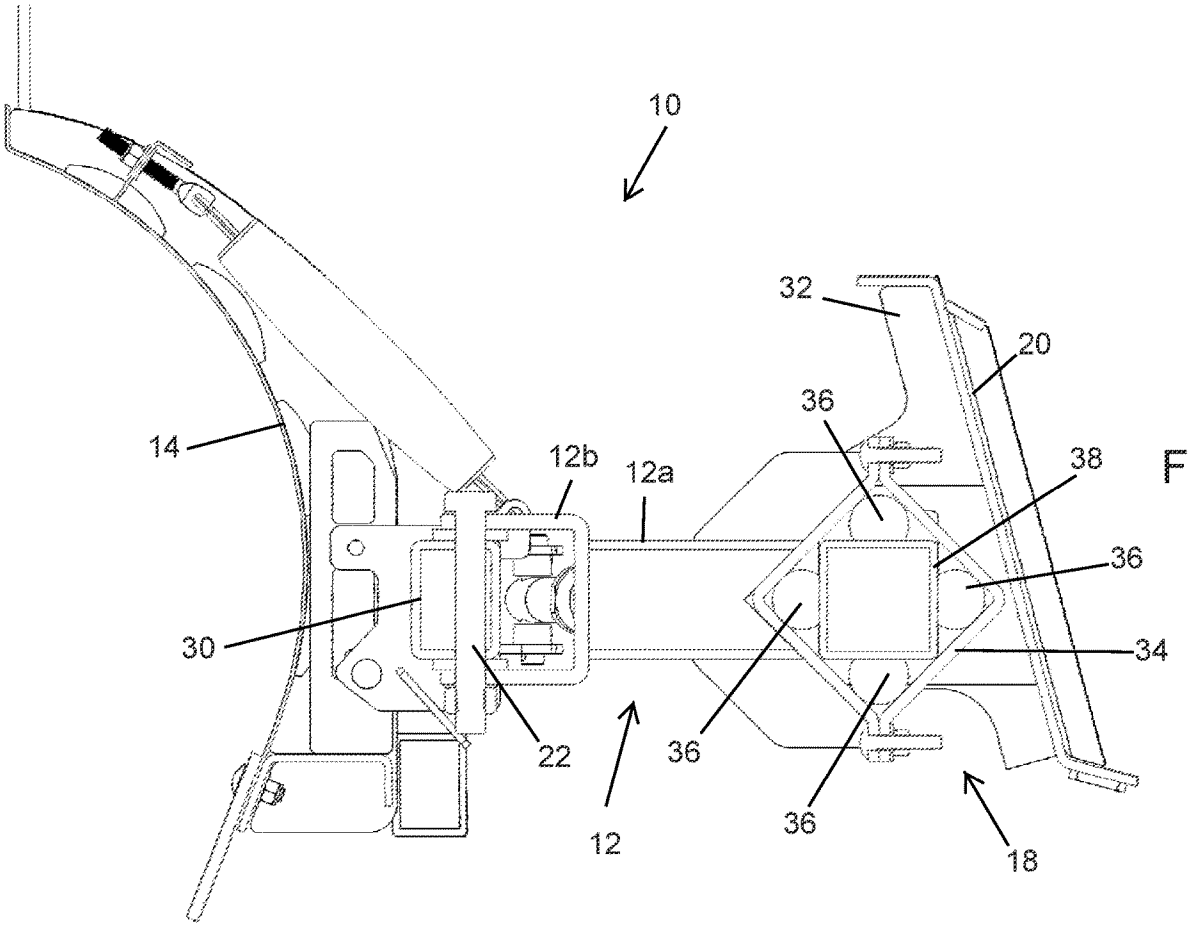
FIG. 4 is a sectional view of the plow assembly of FIG. 1.
Figure 5:
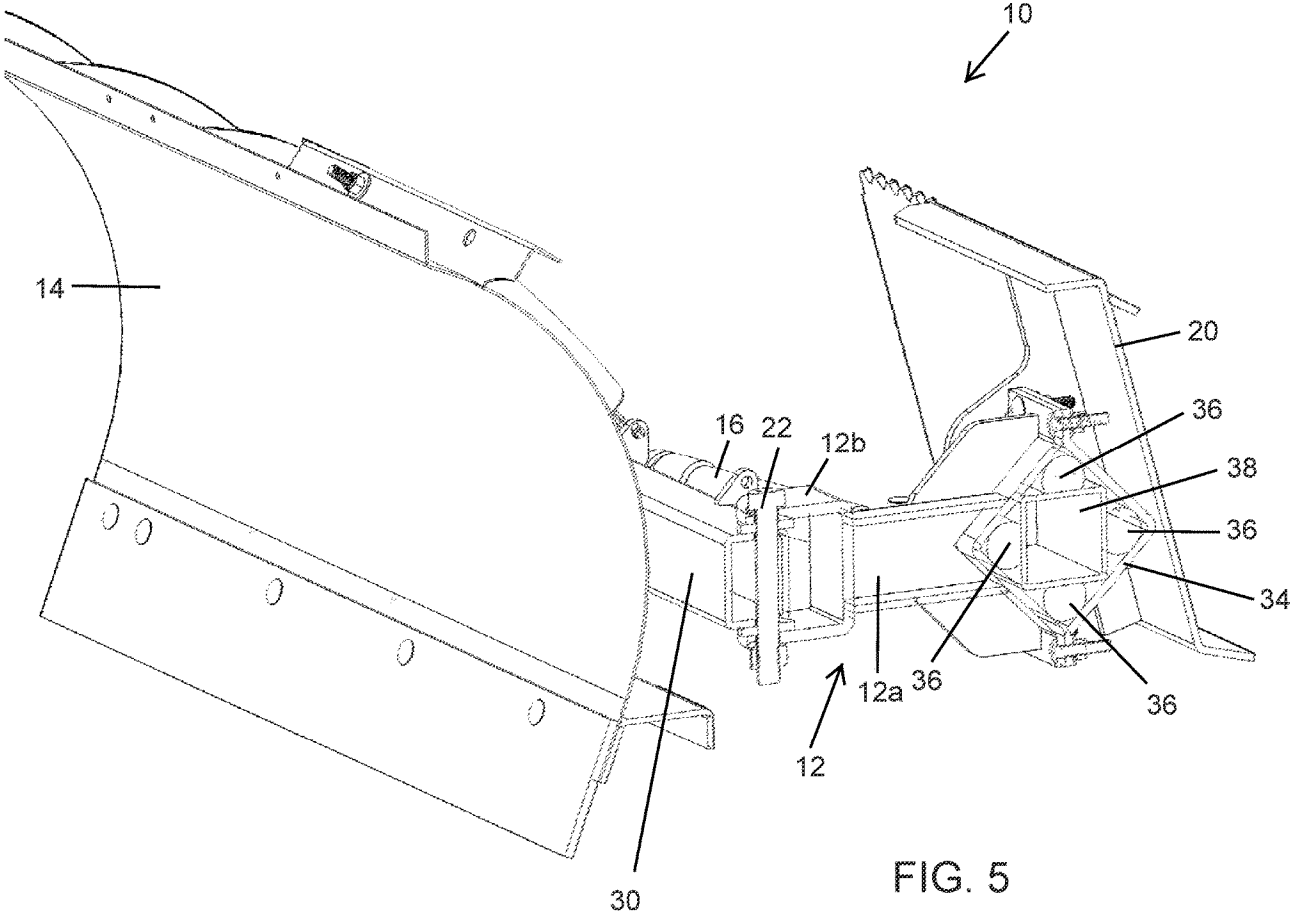
FIGS. 5 and 6 are perspective sectional views of the plow assembly of FIG. 1.
Figure 6:
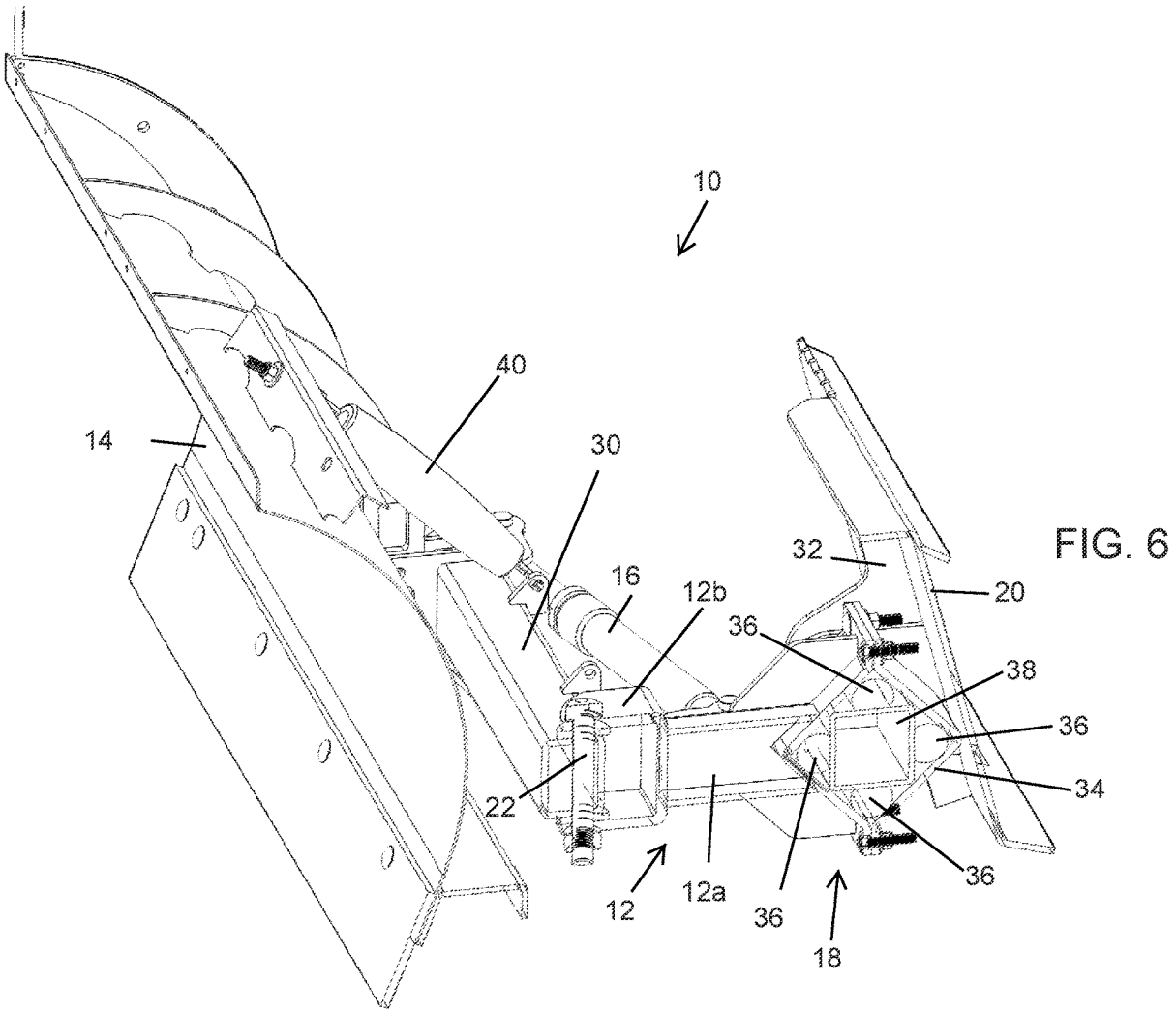
Figure 17:
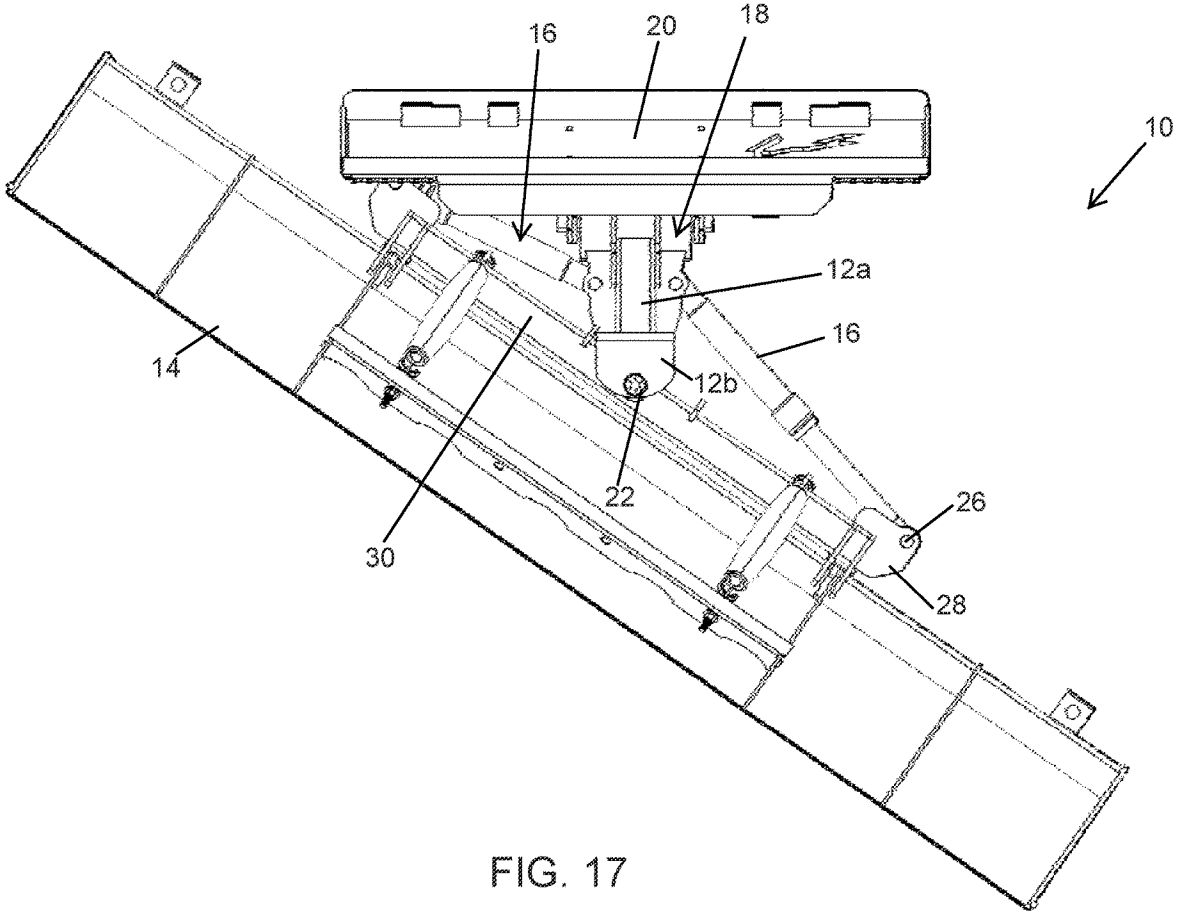
FIG. 17 is a top plan view of the plow assembly of FIG. 1, shown with the plow angled toward one side.

The support assembly 12 of plow assembly 10 is configured to pivotally support the plow 14 so that the plow can be pivoted about a vertical axis so as to pivot side to side via actuation of a respective one of the actuators 16. In the illustrated embodiment, the support assembly 12 comprises a longitudinally extending support beam or element 12*a*, with the plow 14 pivotally mounted at the outer end (distal from the vehicle end) of the support beam 12*a* via a pin 22 at a collar or bracket 12*b* at the outer end of the support beam 12*a* and through a pin receiving aperture or passageway through a support beam 30 at the rear of the plow or mold board 14 (see, for example, FIGS. 4-6). The actuators 16 are also pivotally mounted at one end to the support assembly 12 via respective pins 24 at brackets 12*c* and at the other end via pins 26 at brackets 28 at or near the ends of the support beam 30 at the rear of the plow 14. Thus, the plow can be pivoted side to side (see FIG. 17) relative to the support assembly 12 and the mounting element 20 via selective actuation of the actuators by an operator of the vehicle. The actuators and/or hydraulic control system of the plow assembly may comprise any suitable actuators and control systems (and optionally the plow assembly may include fixed or adjustable plow wings at the ends of the center plow), and may utilize aspects of the actuators and control systems described in U.S. patent application Ser. No. 15/414,941, filed Jan. 25, 2017, which is hereby incorporated herein by reference in its entirety.

Figure 21:
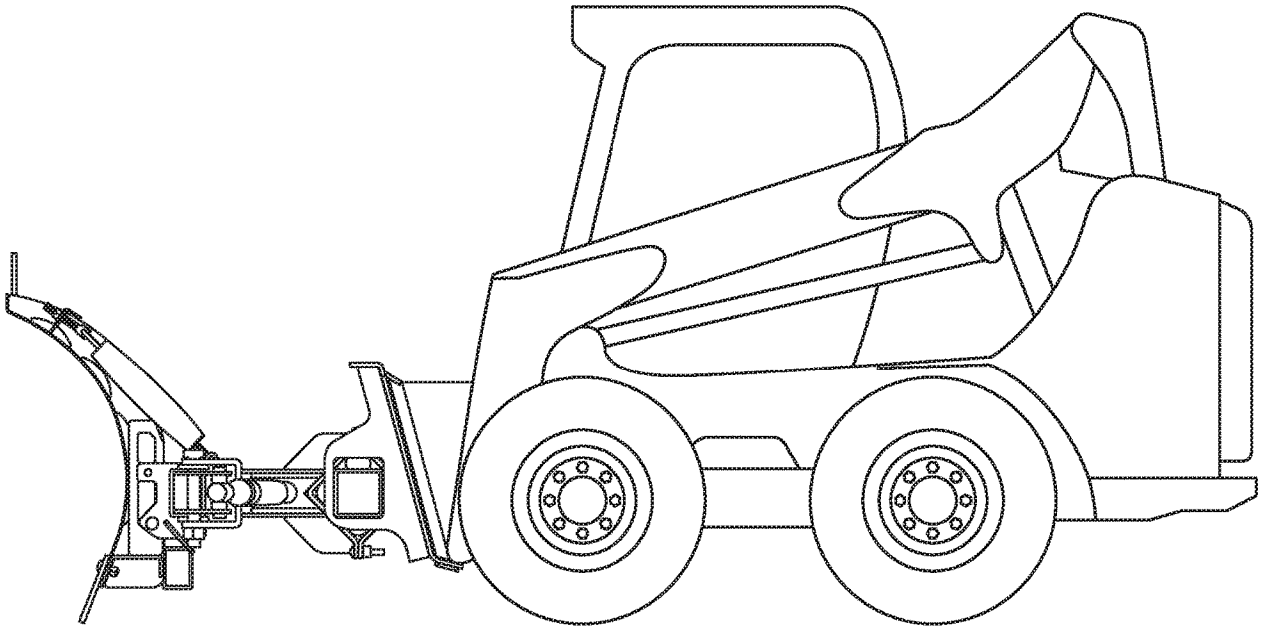
FIG. 21 is a side elevation of the plow assembly attached at a vehicle so as to be pivotable about a horizontal axis at the vehicle.

The mounting element 20 of plow assembly 10 is configured for attachment to a vehicle, such as a skid steer or other vehicle, and attaches to an actuator or actuators at the vehicle that is/are operable to pivot the mounting element 20 about a generally horizontal axis and relative to the vehicle at which it is attached (see FIG. 21). Thus, the operator of the vehicle can raise the plow assembly by actuating the vehicle actuator to pivot the mounting element 20 upwards (to bring the upper region of the mounting element or plate towards the vehicle) to raise the plow, or the operator can lower the plow and support assembly by actuating the vehicle actuator to pivot the mounting element 20 downwards (to move the upper region of the mounting element or plate away from the vehicle) to lower the plow onto the surface to be plowed and optionally to apply a down pressure at the surface. The support assembly 12 is attached at the mounting element via the cushioning assembly 18, whereby the support assembly moves with the mounting element but allows for relative movement of the support assembly to the mounting element, as discussed below.

Figure 3:
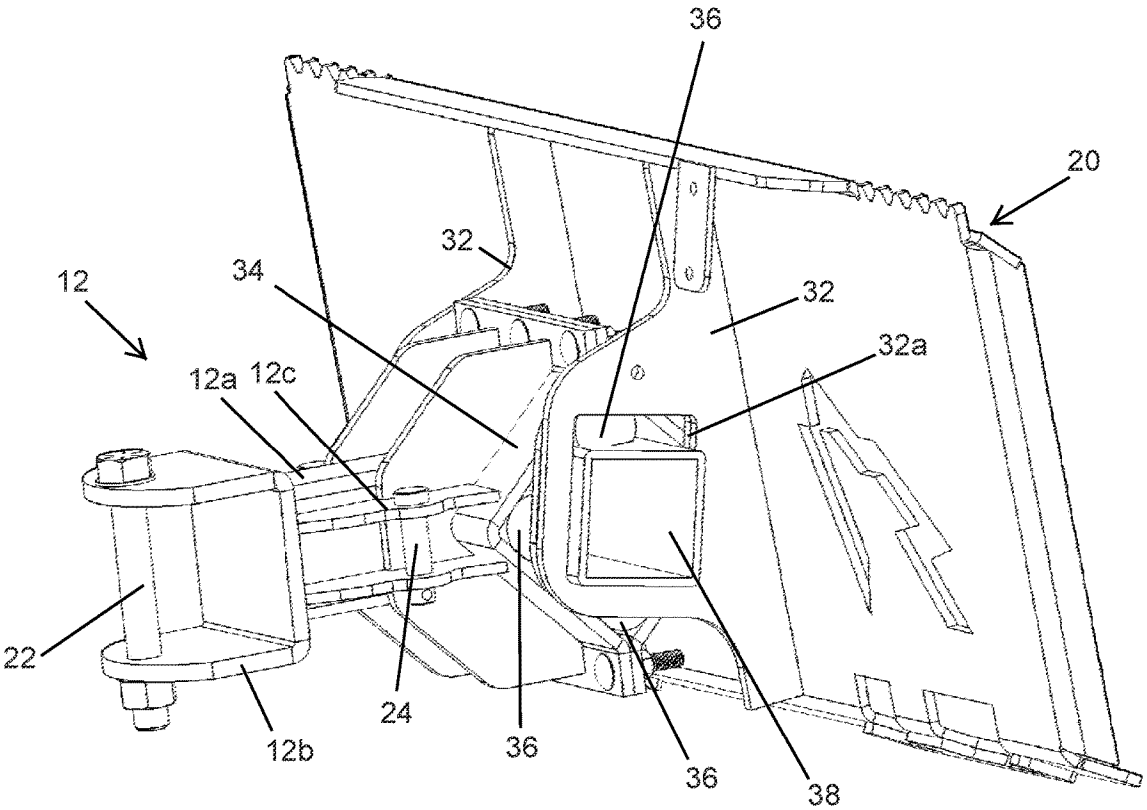
FIG. 3 is a perspective view of the mounting assembly that mounts the plow assembly at the vehicle.

In the illustrated embodiment, and as best seen with reference to FIG. 3, the mounting element 20 includes a pair of spaced apart brackets 32, each having a slot or aperture 32*a* formed therethrough for mounting the cushioning assembly 18 and support assembly 12 at the mounting element 20. The cushioning assembly 18 comprises a non-circular cross section receiver 34 (such as a rectangular-shaped or generally square-shaped hollow construction) that has a plurality of resilient or compressible elements 36 disposed therein, such as at and along the four corners of the receiver 34. A non-circular cross section beam 38 (such as a rectangular-shaped or generally square-shaped construction) is disposed in the receiver 34 and engages each of the resilient elements 36 and protrudes from the ends of the receiver so that the ends of the beam 38 are received in the aperture or slot 32*a* of the brackets 32. In the illustrated embodiment, the receiver 34 comprises a two-piece construction that is bolted together so as to ease assembly of the receiver around the beam 38 and resilient elements 36. In the illustrated embodiment, the receiver 34 is a larger square-shaped cross section as compared to the smaller square-shaped cross section of the beam 38, with the beam 38 rotated about 90 degrees relative to the receiver 34, such that the corners of the beam 38 are at the flats of the receiver 34.

Thus, the beam 38 of cushioning assembly 18 is received through or disposed in the receiver 34 and extends through the slots 32*a* of the brackets 32 of the mounting element 20 to attach the support assembly 12 at the mounting element 20. In the illustrated embodiment, the slots 32*a* are sized or dimensioned so that the beam 38 can move along the slot, such as generally vertically along the slots, but movement in a direction transverse to the allowed movement is constrained or limited by the side walls of the slots 32*a*. Thus, as the mounting element 20 is pivoted (via actuation of a vehicle actuator) about its horizontal pivot axis, the end of the slots (either the upper end of the slot when the actuator pivots the mounting element downward or the lower end of the slot when the actuator pivots the mounting element upward) engages the beam 38 and urges the beam in the respective direction (downward or upward) to lower or raise the plow.

Figure 18:
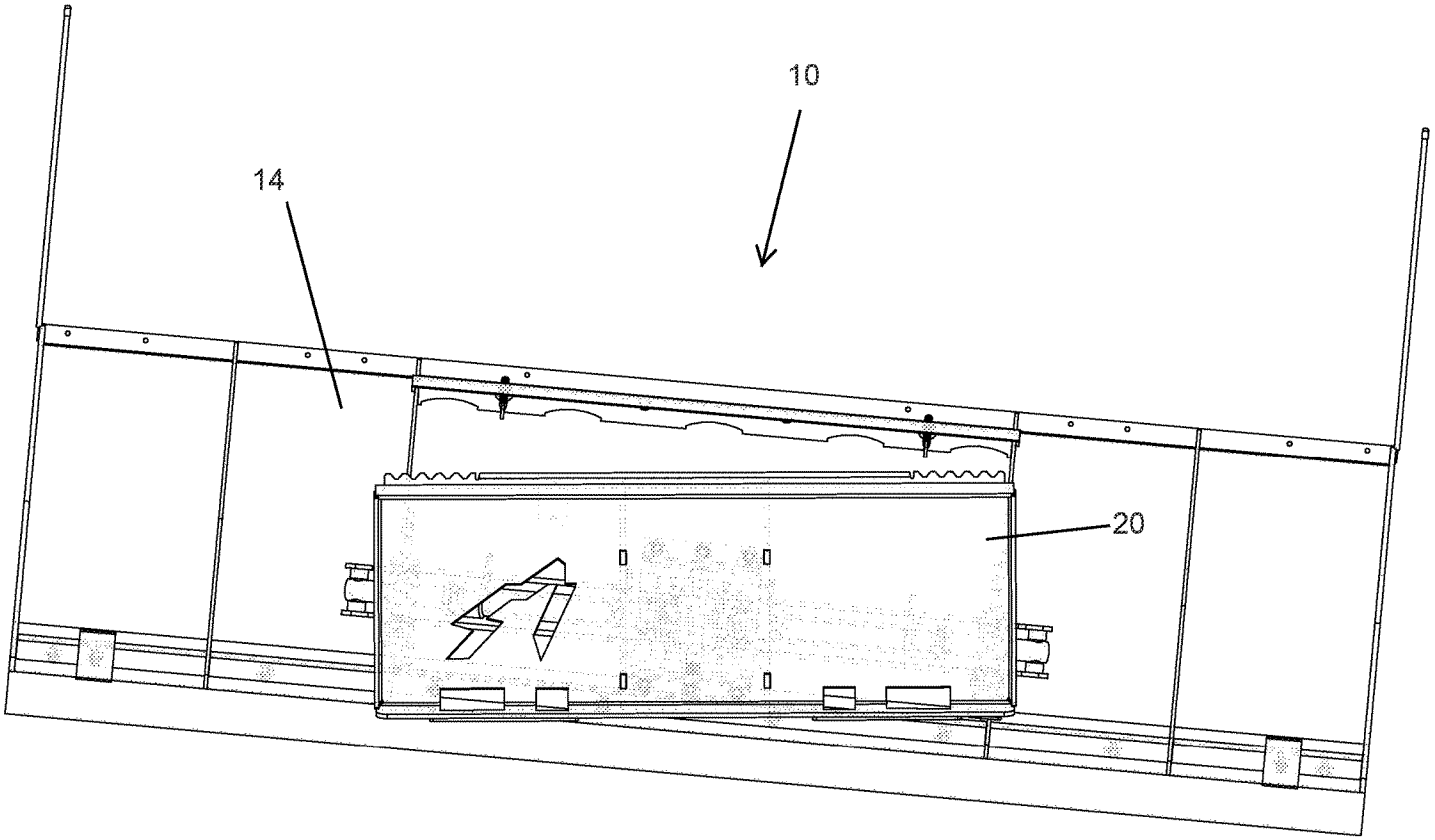
FIG. 18 is a rear elevation of the plow assembly of the present invention, shown with the plow tilted relative to the mounting element with one end of the plow raised relative to the other end.
Figure 19:
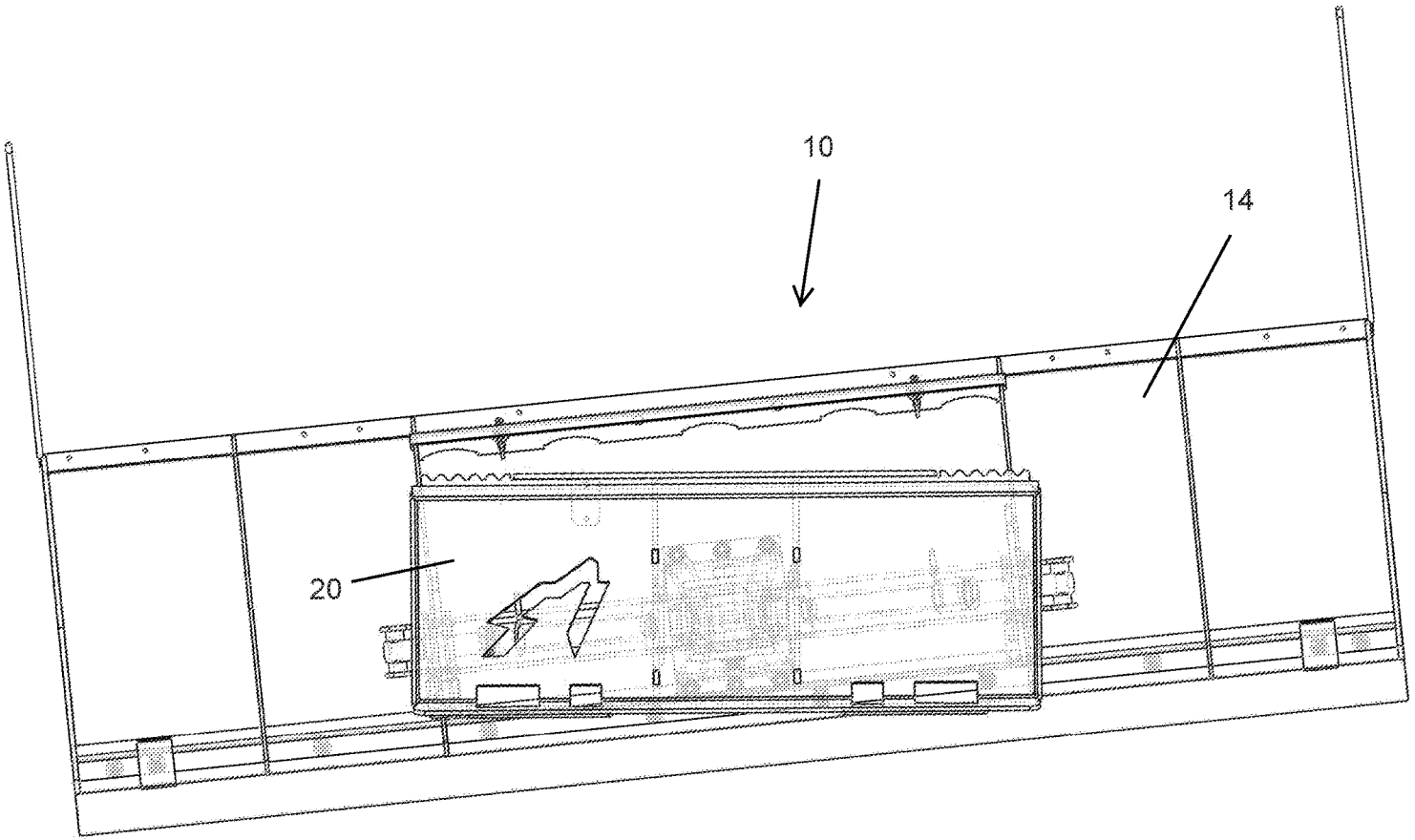
FIG. 19 is another rear elevation of the plow assembly of the present invention, shown with the plow tilted toward the opposite end as that of FIG. 18.

The elongated slots allow for movement of the beam 38 relative to the mounting element, such as during use of the plow to plow a surface. The slots allow for either end of the beam 38 to move relative to the respective bracket 32 of the mounting element 20 independent of the other end of the beam, whereby the slots allow for oscillation or tilting of the beam and of the plow blade (such as shown in FIGS. 18 and 19) as the plow blade encounters uneven terrain or as one end region of the plow strikes an object causing that end to rise upward relative to the other plow end. The slots and resilient elements thus allow for oscillation of the plow blade during use and may be sized to provide a desired degree or amount of oscillation. For example, the slots may allow for vertical movement of an end of beam relative to the bracket of the mounting element that corresponds to about eight inches (or more or less depending on the particular application and length dimension of the slot relative to the cross dimension of the beam) of movement or oscillation of an end of the plow.

The elongated slot configuration is optional, and is provided if the oscillation feature is desired for the particular application of the plow assembly. Optionally, if the plow assembly has an oscillation feature at the attachment of the plow to the support structure or in the support structure itself, the cushioning assembly 18 may have apertures in the brackets 32 that snugly or non-movably receive the ends of the beam therein, such that the beam does not move relative to the brackets 32 (but otherwise moves relative to the receiver and resilient elements in a similar manner as discussed herein). In such an embodiment, the apertures of the brackets of the mounting element 20 may comprise square-shaped apertures (or other shapes) that receive the square-shaped beam (or other shapes) therein.

Figure 7:
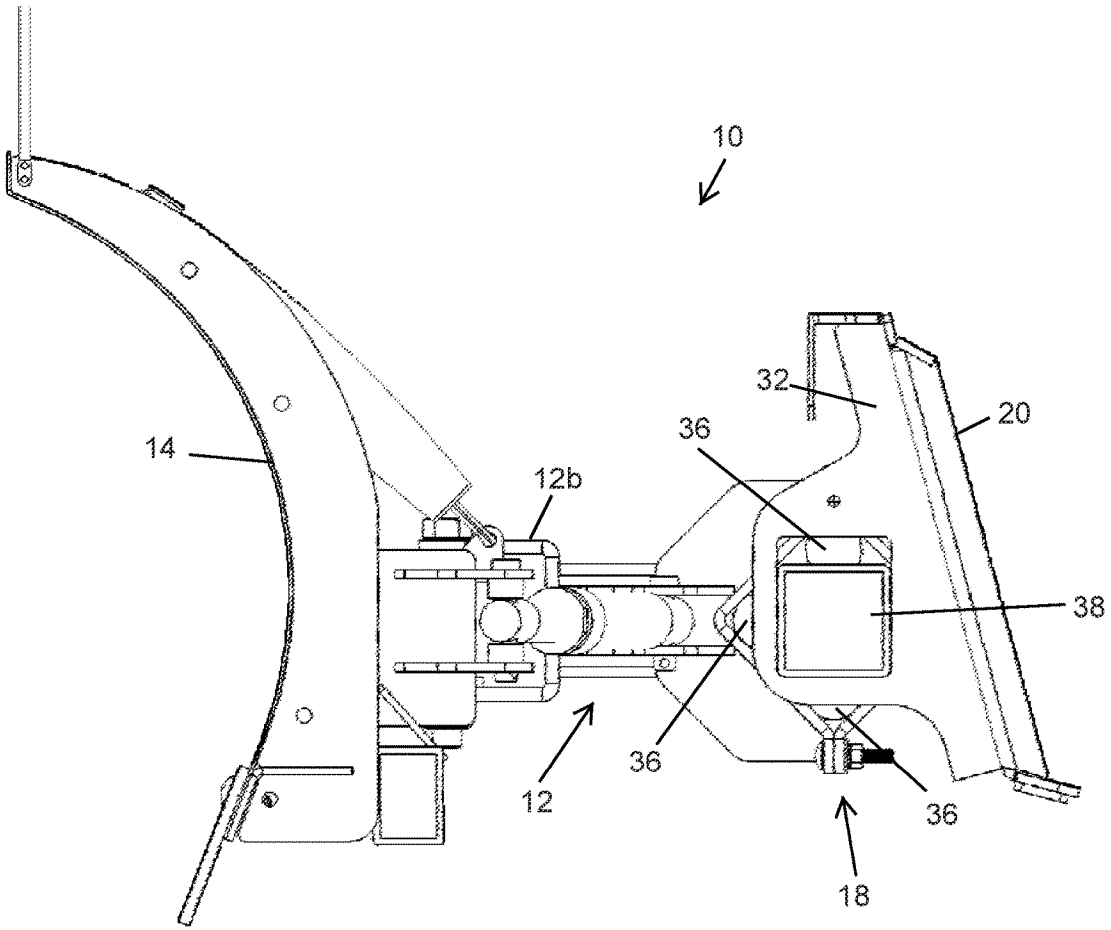
FIG. 7 is a side elevation of the plow assembly of FIG. 1.
Figure 8:
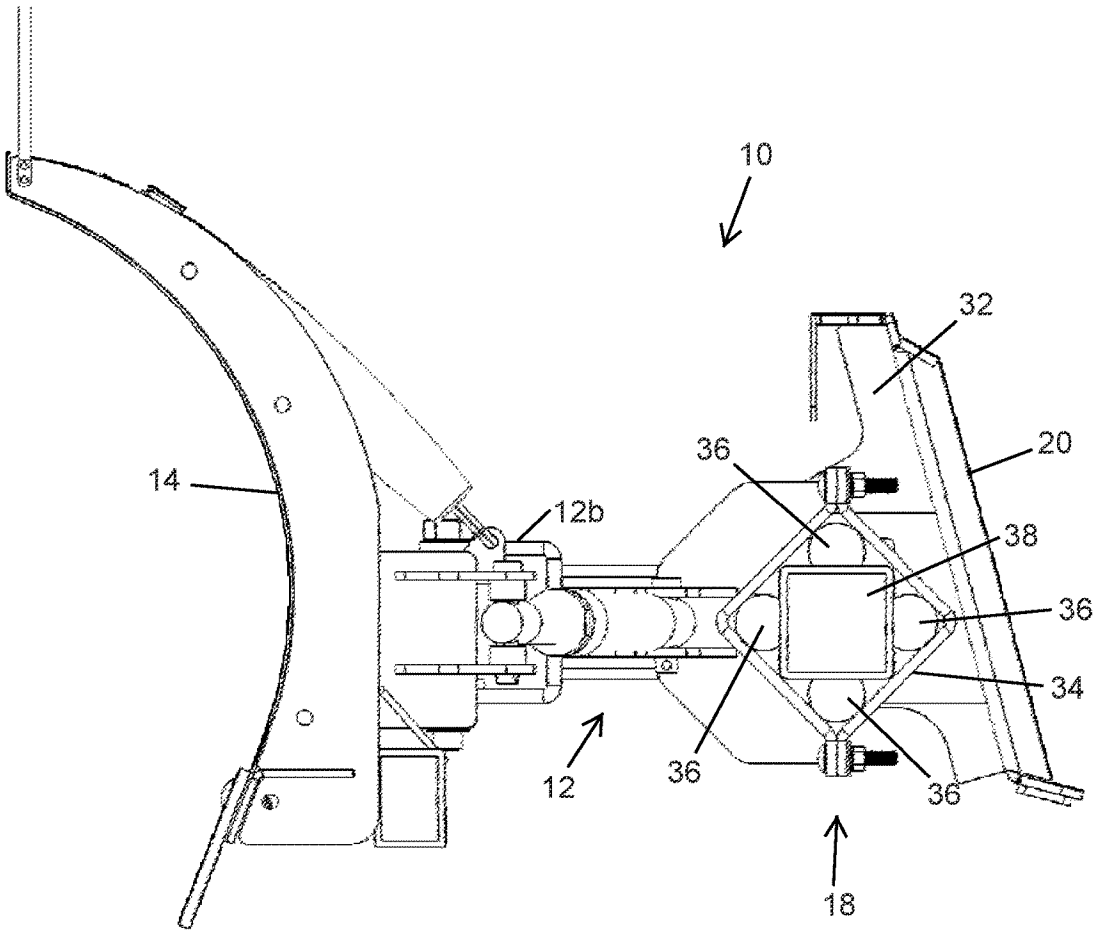
FIG. 8 is a side elevation of the plow assembly of FIG. 7, with the side brackets removed to show additional details.
Figure 9:
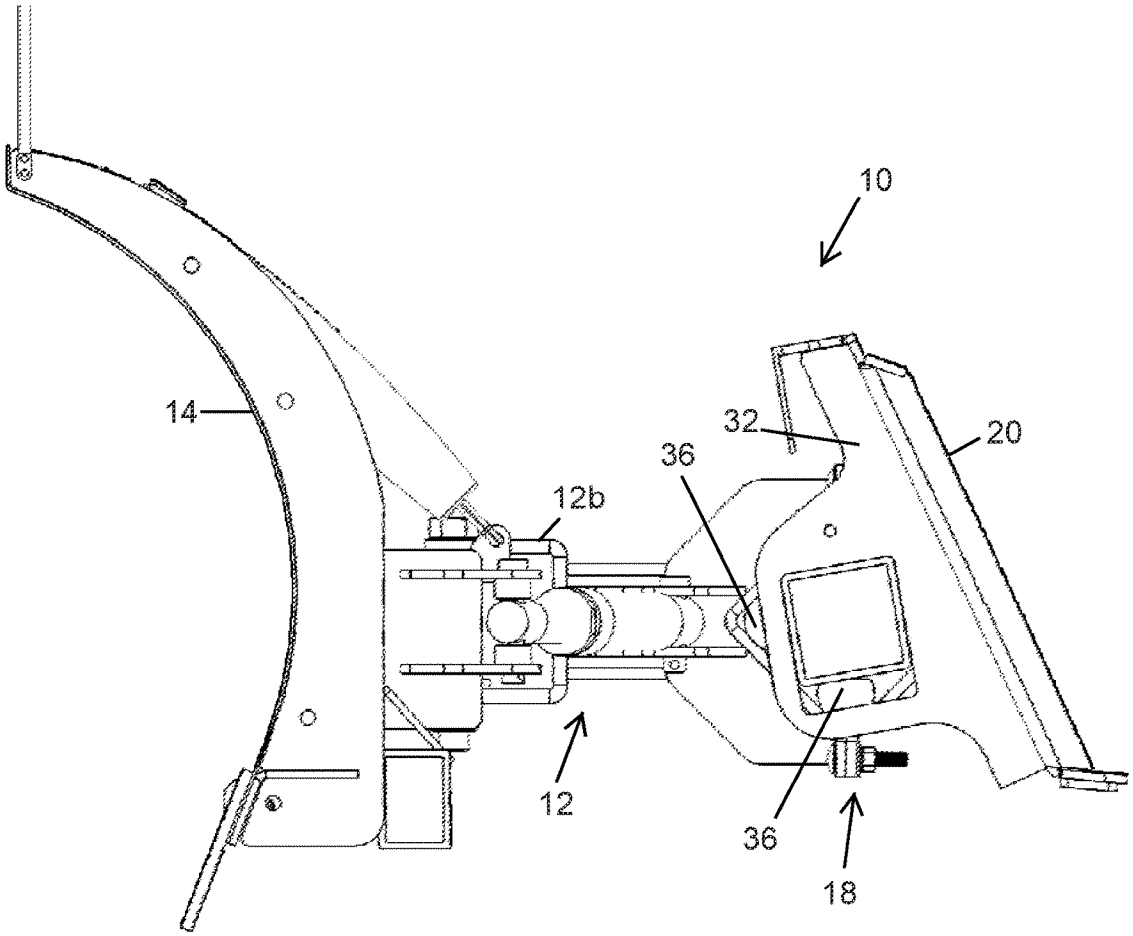
FIG. 9 is a side elevation of the plow assembly of the present invention, shown in a lowered or down pressure position.
Figure 10:
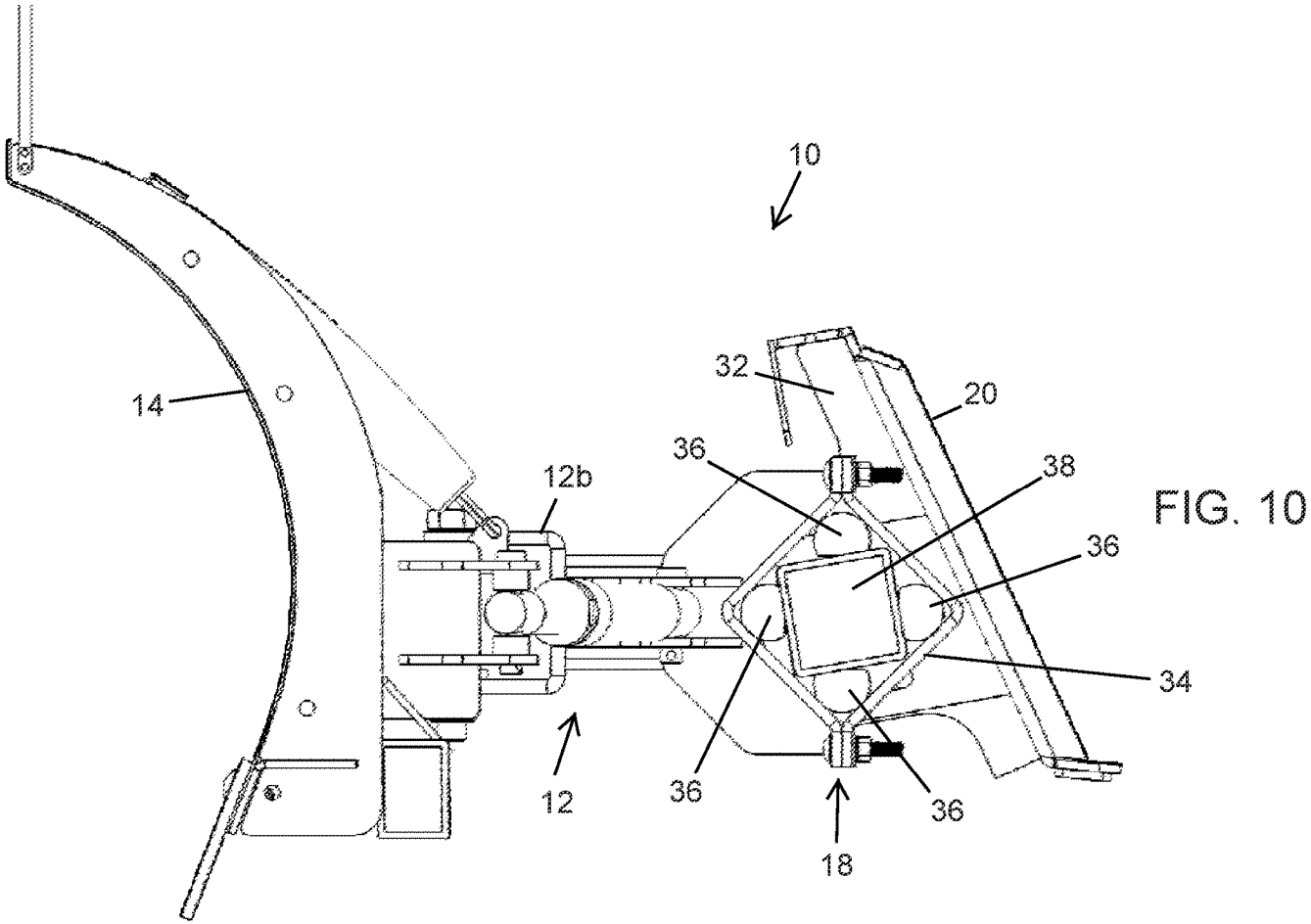
FIG. 10 is a side elevation similar to FIG. 9, with the side brackets removed to show additional details.

As can be seen with references to FIGS. 7 and 8, when the plow 14 is in its generally neutral position (such as for plowing with no down pressure), the beam 38 is generally centered in the receiver 34 and the center regions of the walls of the beam 38 engage and compress all four resilient elements 36 substantially the same amount, thus allowing the plow blade 14 to generally float relative to the vehicle and to move upward or downward relative to the vehicle in response to impacts with various objects encountered while plowing a surface. As can be seen with further reference to FIGS. 9 and 10, when the mounting element 20 is pivoted downward, the beam 38 may move along the slot 32*a* (if the slot is configured to allow such movement of the beam relative to the bracket) until the upper end of the slot engages the beam and urges the beam 38 downward relative to the receiver 34 (which is limited in downward movement due to resistance encountered when the plow engages the surface being plowed). As can be seen by comparing FIGS. 8 and 10, the beam 38, when urged downward and against the resilient elements 36, rotates within the receiver 34 (such as in the counter-clockwise direction in FIG. 10) such that end regions of the walls of the beam engage and further compress the resilient elements 36.

Figure 11:
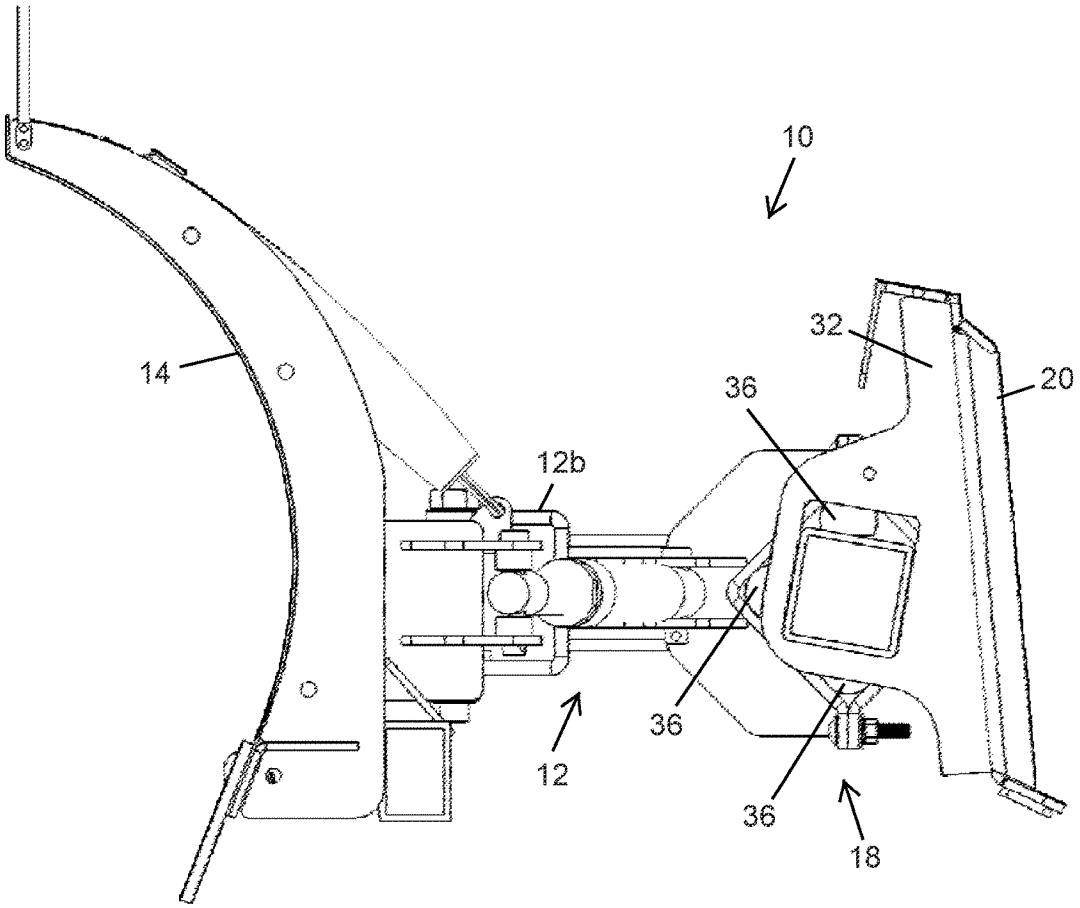
FIG. 11 is a side elevation of the plow assembly of the present invention, shown in a raised position.
Figure 12:
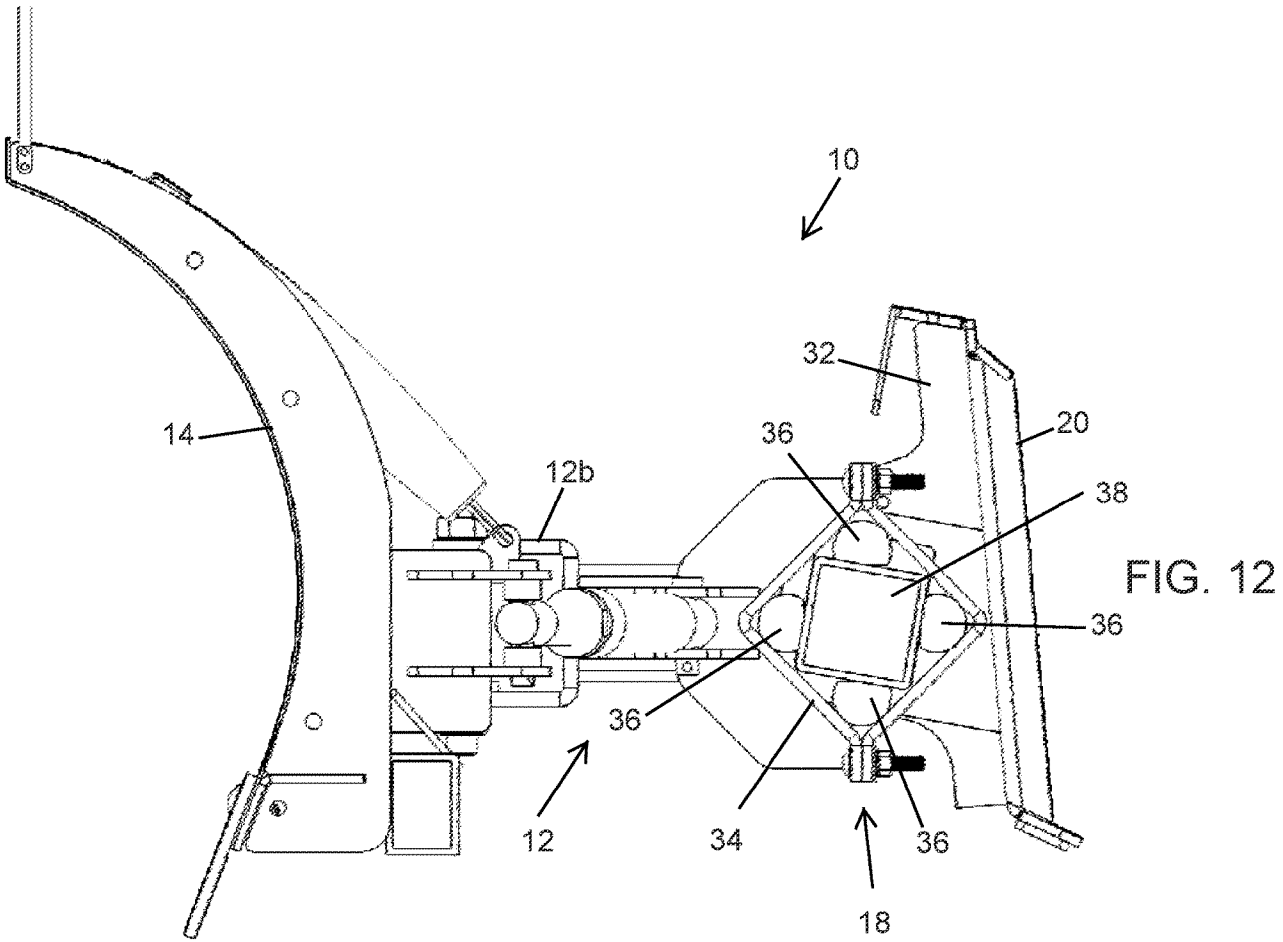
FIG. 12 is a side elevation similar to FIG. 11, with the side brackets removed to show additional details.
Figure 13:
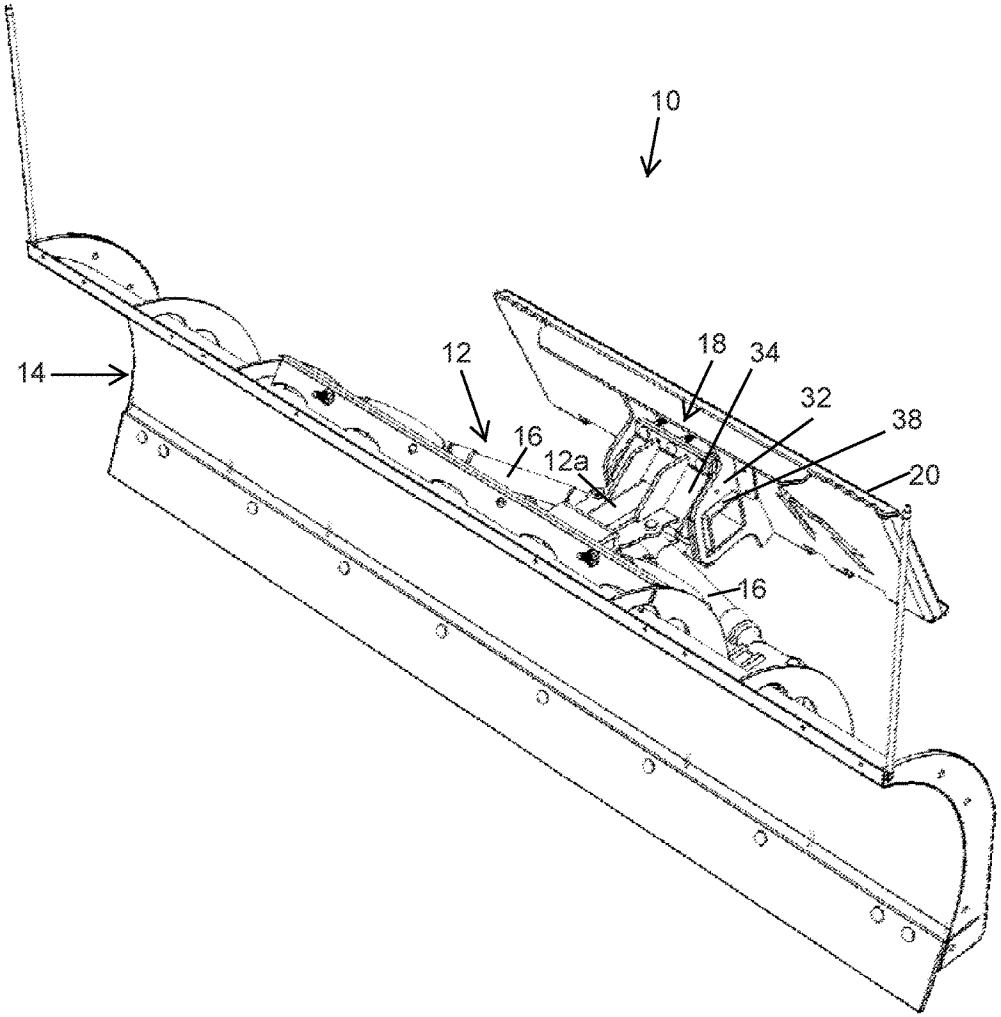
FIG. 13 is a perspective view of a plow assembly in accordance with the present invention, shown in lowered or down pressure position.
Figure 14:
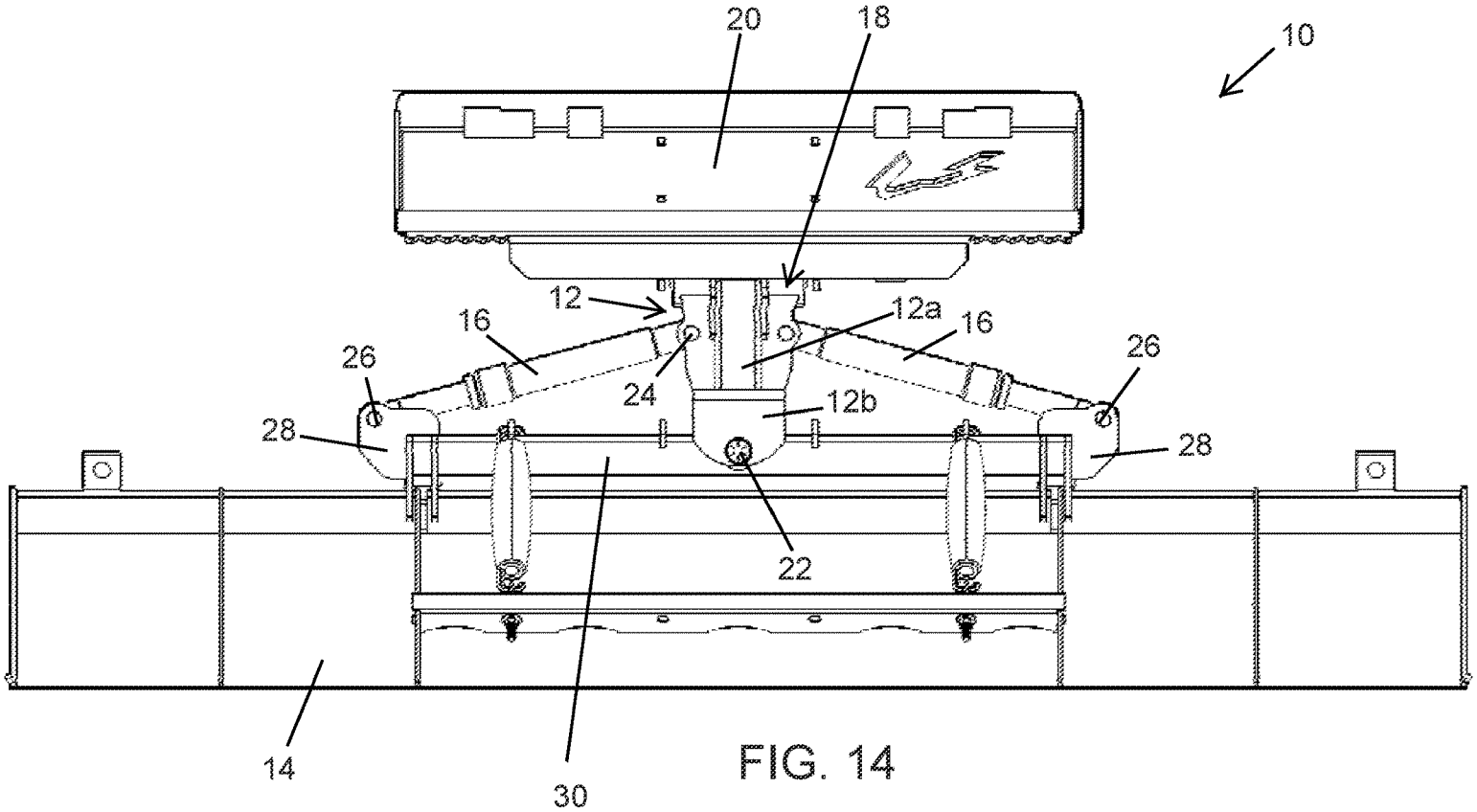
FIG. 14 is a top plan view of the plow assembly of FIG. 13.
Figure 15:
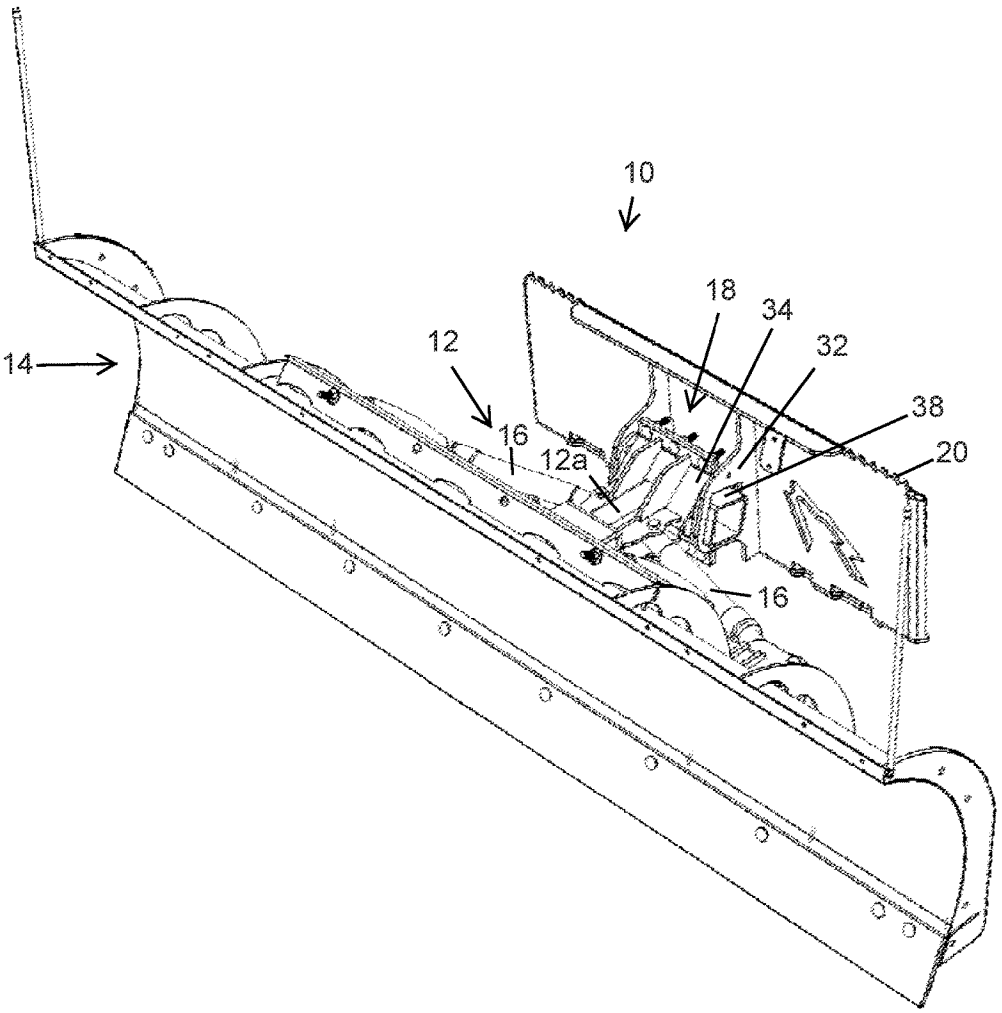
FIG. 15 is a perspective view of a plow assembly in accordance with the present invention, shown in a raised position.
Figure 16:
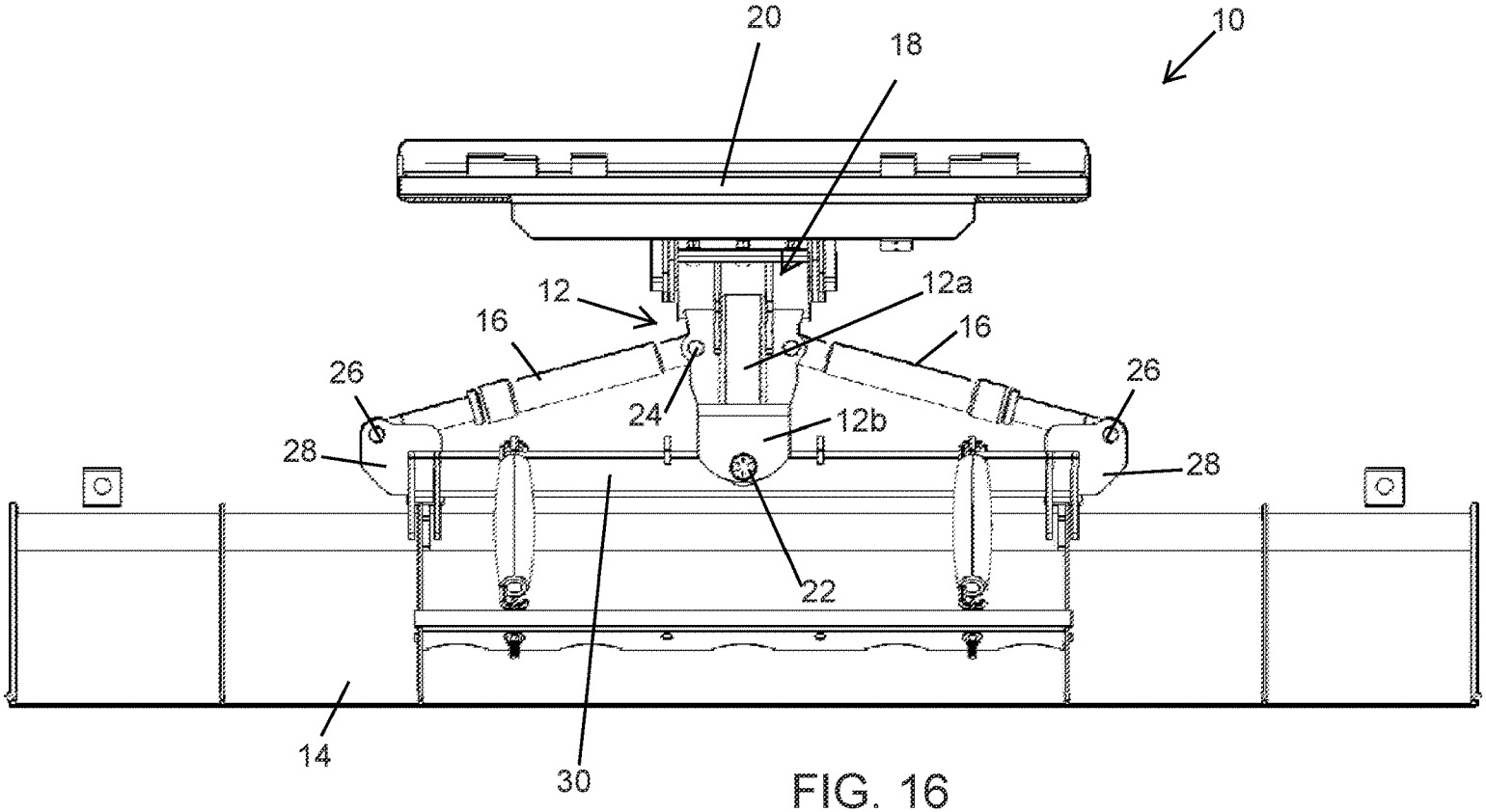
FIG. 16 is a top plan view of the plow assembly of FIG. 15.

Likewise, and such as shown in FIGS. 11 and 12, when the mounting element 20 is pivoted upward, such as to raise the plow, the beam 38 may move along the slot 32*a* (if the slot is configured to allow such movement of the beam relative to the bracket) until the lower end of the slot engages the beam and urges the beam 38 upward relative to the receiver 34 to lift the plow. As can be seen by comparing FIGS. 8 and 10 with FIG. 12, the beam 38, when urged upward, rotates within the receiver 34 (such as in the clockwise direction in FIG. 12) such that opposite end regions of the walls of the beam (the opposite end regions from the end regions that engage the resilient elements when the plow is urged downward) engage and further compress the resilient elements 36.

The resilient elements 36 thus provide a cushioning feature at the attachment of the support assembly 12 to the mounting element 20. The resilient elements may comprise any suitable compressible material or biasing material or elastomeric material that is compressible and that is biased towards its initial non-compressed form, such as, for example, rubber or urethane or other composites. The material for the resilient elements may be selected to provide different resistance or torsion levels, depending on the particular application of the plow assembly. For example, the degree of down pressure applied by the cushioning assembly to the plow may be adjusted by selection of a different hardness or resiliency or durometer material or by using more or less resilient elements between the beam and receiver.

Although shown and described with four separate resilient elements disposed at and around a rectangular-shaped beam, the cushioning assembly of the present invention may optionally use only two such resilient elements (such as forward and rearward resilient elements), whereby the cushioning assembly still absorbs or dampens impact of the plow with an object and still applies down pressure of the plow to the surface being plowed, but to a lesser degree than when four resilient elements are used. It is also envisioned that any other number of resilient elements may be used, depending on the shape of beam and receiver. For example, if the beam has a hexagonal shaped cross section, the cushioning assembly may have three or six resilient elements disposed at the flats or sides of the beam and corners of the similarly shaped receiver. Clearly, other shapes or cross sections of beams and receivers are contemplated by and within the scope of the present invention.

Optionally, it is further envisioned that a single resilient element may be disposed at or molded over the beam and within the receiver, with increased thickness dimensions at the portions of the resilient element that are disposed generally at the corner regions of the receiver, whereby the molded element resists rotation of the beam within the receiver and cushions the beam relative to the receiver in a similar manner as the multiple resilient elements of the illustrated embodiment. Optionally, it is envisioned that various resilient or spring-like or biasing elements (including a plurality of springs) may be disposed between a support beam and a receiver to allow the controlled movement and cushioning affect, while remaining within the spirit and scope of the present invention.

The present invention thus allows the operator to control the raising and lowering and torsional movement of the plow blade relative to the vehicle in both directions by controlling the tilt actuator or actuators of the vehicle or skid steer. The resilient elements (and receiver and support beam) of the present invention allow for limited and controlled relative movement of the support assembly and the mounting element, while providing a cushioning or shock absorbing feature (in addition to a pivotal shock absorbing feature provided by one or more springs 40 disposed between the plow blade or mold board 14 and the support beam 30). Additionally, the resilient elements (and receiver and support beam) of the present invention allow the user to apply a down pressure of the plow blade at the surface being plowed and allow for variable down pressure to be applied depending on the degree of pivoting of the mounting element or plate mounted to the actuator(s) of the vehicle or skid steer. Even with the mounting element pivoted to apply a substantial down pressure at the surface being plowed, the resilient elements still function to limit or absorb shock due to impact of the blade with an object during plowing of the surface.

Figure 20:
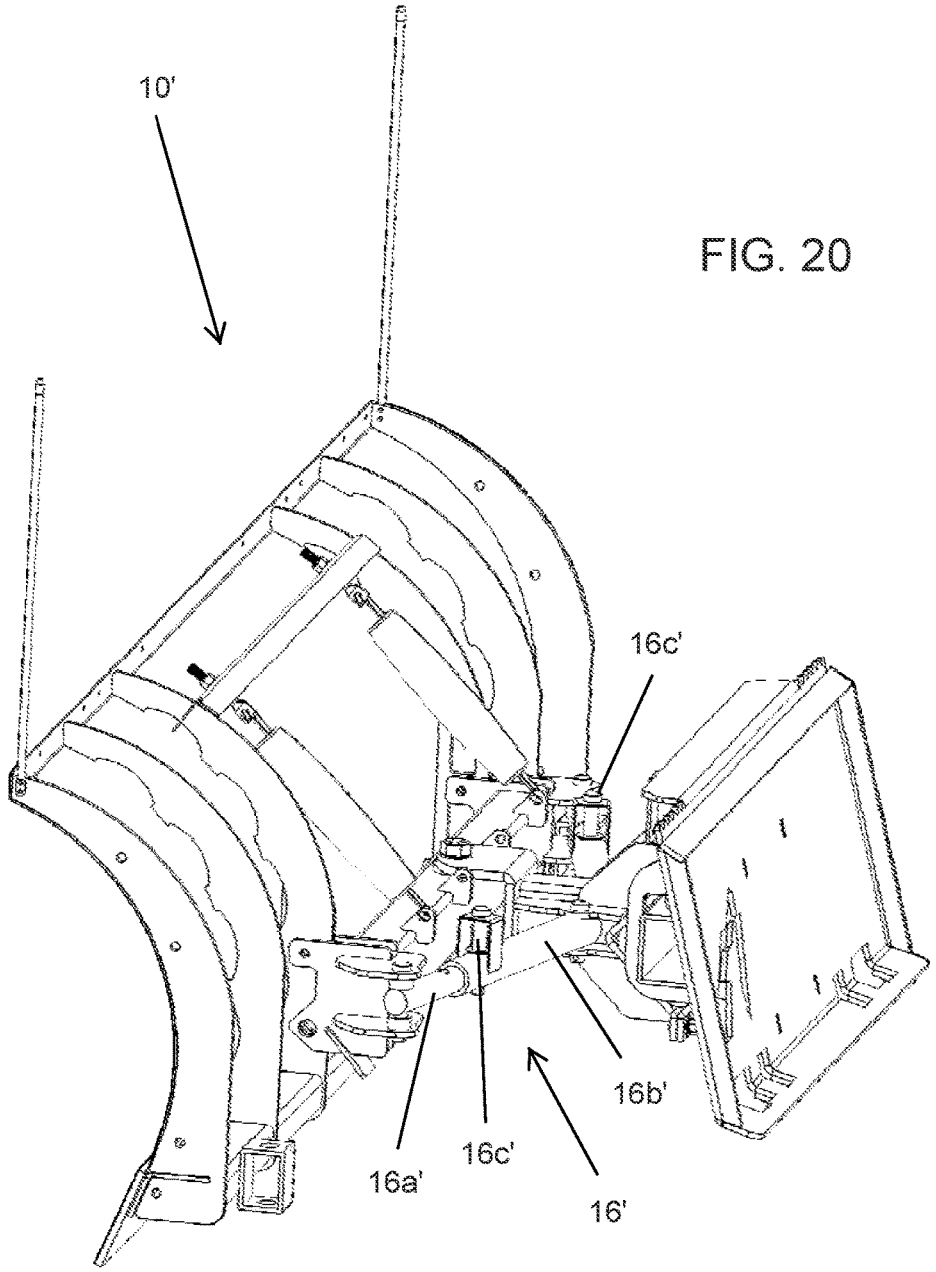
FIG. 20 is a rear perspective view of another plow assembly of the present invention, shown with manually adjustable telescoping linkages used to turn the plow towards one side or the other.

Although shown and described as having powered actuators or hydraulic cylinders for pivoting the plow assembly side to side, it is envisioned that the plow assembly may be fixed or may be selectively set at a desired straight or angled orientation, while remaining within the spirit and scope of the present invention. For example, and such as shown in FIG. 20, a plow assembly 10' may include manually adjustable arms or linkages or telescoping elements 16' that may have a rod 16*a*' movably disposed at a cylinder 16*b*', whereby a user may pull a pin 16*c*' at the cylinder to disengage the pin from the cylinder and rod, and then the user may adjust the degree of extension of the rod from the cylinder and re-insert the pin in the cylinder and rod to maintain the link or arm at the selected length. Such a plow assembly and manual adjustment allows the user to selectively pivot the plow to one side or the other and to lock or retain the plow at the desired orientation, and does not require that the plow assembly connect to a hydraulic system of the vehicle. The plow assembly 10' may otherwise be substantially similar to plow assembly 10, discussed above, such that a detailed discussion of the plow assemblies need not be repeated herein.

Therefore, the present invention provides a unique snow plow attachment system or method, with a composite torsion system that secures the snow plow push frame or support frame or A-frame to the mounting element or plate that attaches to the vehicle. The present invention allows the operator to put infinitely variable down pressure on the snow plow blade to improve scraping and back dragging characteristics. The system of the present invention provides a cushioned raised or lift/carry position that allows the operator to lift and carry the plow blade via the composite torsion system which reduces or absorbs or eliminates road bounce, is easier on the vehicle, and provides a smoother ride for the operator. Also, the system of the present invention provides impact cushion protection, whereby if the operator runs into an immovable object while plowing, the composite torsion system flexes and helps to absorb the shock and cushion the impact, and thus reduces breakage of components. Although shown and described as being a mounting and cushioning system for a plow (such as a snow plow or the like), the mounting system of the present invention is suitable for mounting other accessories at a vehicle, such as, for example, a back drag attachment at a rear of a vehicle or a grapple bucket attachment or asphalt milling machine attachment or the like at the front of the vehicle.

Changes and modifications in the specifically described embodiments may be carried out without departing from the principles of the present invention, which is intended to be limited only by the scope of the appended claims as interpreted according to the principles of patent law.

The invention claimed is:

1. A plow assembly for mounting at a vehicle, said plow assembly comprising:

a mounting structure configured to mount at a vehicle;

a support structure comprising a vehicle end and an attaching end, wherein said vehicle end is attached to said mounting structure via a cushioning assembly;

a plow pivotally attached at said attaching end of said support structure and pivotable about a generally vertical axis;

wherein said cushioning assembly comprises (i) a first element attached at said vehicle end of said support structure, (ii) a second element attached at said mounting structure, and (iii) a plurality of resilient elements disposed between said first element and said second element;

wherein said mounting structure is configured to adjustably mount at the vehicle so as to be adjustable about a horizontal pivot axis relative to the vehicle; and wherein said first element comprises a non-circular receiver fixedly attached at said vehicle end of said support structure, and wherein said second element comprises a non-circular beam that is received within said receiver and that engages said plurality of resilient elements.

2. The plow assembly of claim 1, wherein said receiver comprises a square cross section shape and wherein said beam comprises a square cross section shape.

3. The plow assembly of claim 1, wherein said plurality of resilient elements comprise elongated resilient elements disposed at least partially along said receiver at corner regions of said receiver.

4. The plow assembly of claim 1, wherein each of said resilient elements comprises an elastomeric material that is compressible and biased towards its initial form.

5. The plow assembly of claim 1, wherein said beam is movably attached at said mounting structure.

6. The plow assembly of claim 5, wherein opposite end regions of said beam are received through a slot of a respective bracket of said mounting structure.

7. The plow assembly of claim 6, wherein each of said slots of said bracket comprises an elongated slot that allows for movement of the respective end region of said beam relative to said mounting structure in a first direction and limits movement of the respective end region of said beam relative to said mounting structure in a second direction orthogonal to said first direction.

8. The plow assembly of claim 7, wherein each of said elongated slots allows for movement of the respective end of said beam at that slot relative to the other end of said beam to allow for oscillation of said plow.

9. The plow assembly of claim 1, wherein, responsive to pivotal movement of said mounting structure about said horizontal pivot axis, said beam pivots within said receiver.

10. The plow assembly of claim 9, wherein opposite end regions of said beam are received through a slot of a respective bracket of said mounting structure, and wherein said slot of each of said brackets comprises an elongated slot that allows for movement of the respective end region of said beam relative to said mounting structure in a first direction and limits movement of the respective end region of said beam relative to said mounting structure in a second direction orthogonal to said first direction.

11. The plow assembly of claim 10, wherein, responsive to pivotal movement of said mounting structure to lower said plow, said beam moves upward along said slots and rotates about a horizontal axis within said receiver in a first direction.

12. The plow assembly of claim 11, wherein, responsive to pivotal movement of said mounting structure to raise said plow, said beam moves downward along said slots and rotates about said horizontal axis within said receiver in a second direction opposite said first direction.

13. The plow assembly of claim 1, wherein each of said resilient elements comprises an elastomeric material that is compressible and biased towards its initial form.

14. The plow assembly of claim 1, wherein said plurality of resilient elements comprise a plurality of resilient portions of a unitary resilient element disposed in and at least partially along said receiver and between said receiver and said beam.

15. A accessory assembly for mounting at a vehicle, said accessory assembly comprising:

a mounting structure configured to mount at a vehicle;

wherein said mounting structure is configured to adjustably mount at the vehicle so as to be adjustable about a horizontal pivot axis relative to the vehicle;

a support structure comprising a vehicle end and an attaching end, wherein said vehicle end is attached to said mounting structure via a cushioning assembly;

an accessory attached at said attaching end of said support structure;

wherein said cushioning assembly comprises (i) a first element attached at said vehicle end of said support structure, (ii) a second element attached at said mounting structure, and (iii) a plurality of resilient elements disposed between said first element and said second element;

wherein said first element comprises a non-circular receiver fixedly attached at said vehicle end of said support structure, and wherein said second element comprises a non-circular beam that is received within said receiver and that engages said plurality of resilient elements;

wherein each of said resilient elements is compressible and biased towards its initial form;

wherein, responsive to pivotal movement of said mounting structure about said horizontal pivot axis, said beam pivots within said receiver to compress at least some of said resilient elements;

wherein said beam is movably attached at said mounting structure; and wherein said beam is received through slots of respective brackets of said mounting structure, and wherein said slot of each of said brackets comprises an elongated slot that allows for movement of a respective end region of said beam relative to said mounting structure in a first direction and limits movement of the respective end region of said beam relative to said mounting structure in a second direction orthogonal to said first direction.

16. The accessory assembly of claim 15, wherein said receiver comprises a square cross section shape and wherein said beam comprises a square cross section shape.

17. The accessory assembly of claim 15, wherein each of said elongated slots allows for movement of the respective end region of said beam at that slot relative to the other end region of said beam at the other slot to allow for oscillation of said accessory.

18. The accessory assembly of claim 17, wherein, responsive to pivotal movement of said mounting structure to lower said accessory, said beam moves upward along said slots and rotates about a horizontal axis within said receiver in a first direction.

19. The accessory assembly of claim 18, wherein, responsive to pivotal movement of said mounting structure to raise said accessory, said beam moves downward along said slots and rotates about said horizontal axis within said receiver in a second direction opposite said first direction.

20. The accessory assembly of claim 15, wherein said plurality of resilient elements comprise a plurality of resilient portions of a unitary resilient element disposed in and at least partially along said receiver and between said receiver and said beam.

* * * * *